US008132273B2

(12) United States Patent
Bouchard

(10) Patent No.: US 8,132,273 B2
(45) Date of Patent: Mar. 13, 2012

(54) TOILET FILL VALVE INCLUDING LEAK PREVENTION MECHANISM

(75) Inventor: Peter Bouchard, Ayers, MA (US)

(73) Assignee: Watts Water Technologies, Inc., North Andover, MA (US)

( * ) Notice: Subject to any disclaimer, the term of this patent is extended or adjusted under 35 U.S.C. 154(b) by 979 days.

(21) Appl. No.: 12/074,160

(22) Filed: Feb. 29, 2008

(65) Prior Publication Data

US 2008/0209619 A1 Sep. 4, 2008

Related U.S. Application Data

(60) Provisional application No. 60/892,781, filed on Mar. 2, 2007.

(51) Int. Cl.
*E03D 1/36* (2006.01)
*E03D 1/00* (2006.01)
*F16K 31/18* (2006.01)

(52) U.S. Cl. ..... 4/366; 4/353; 4/415; 137/410; 137/432; 137/445

(58) Field of Classification Search ..... 137/409, 137/434, 445, 410, 429, 430, 432, 446, 468; 251/231, 251, 229; 4/391, 394, 395–401, 4/366, 353, 415

See application file for complete search history.

(56) References Cited

U.S. PATENT DOCUMENTS

| | | | | |
|---|---|---|---|---|
| 2,504,555 | A * | 4/1950 | Loether | 4/397 |
| 2,837,111 | A | 6/1958 | Mueller | |
| 4,230,145 | A * | 10/1980 | Badders | 137/410 |
| 4,745,945 | A | 5/1988 | Miller | |
| 5,769,111 | A * | 6/1998 | Han | 137/312 |

OTHER PUBLICATIONS

HydroClean; "The Revolutionaly New Toilet Valve!" Fact Sheet; MJSI, Inc., 2006.

HydroClean; "Model 550 & 660 Installation Instructions"; MJSI, Inc.

"Fluidmaster 400A Fill Valve Installation Instructions"; Fluidmaster Inc., Dec. 2003.

* cited by examiner

*Primary Examiner* — Jason J Boeckmann
*Assistant Examiner* — Justin Jonaitis
(74) *Attorney, Agent, or Firm* — Edwards Wildman Palmer LLP; David J. Silvia; George N. Chaclas

(57) ABSTRACT

A toilet fill valve having a mechanism for preventing leakage from a tank of the toilet between flush cycles. The mechanism includes links that are normally locked to prevent the fill valve from opening. The links are operatively connected to a handle of the toilet such that the links are unlocked and allow the fill valve to open only when the handle of the toilet is purposely operated to initiate a flush cycle. Otherwise, the links do not allow the fill valve to open even if water leaks from the tank and causes a float of the fill valve to be lowered.

17 Claims, 8 Drawing Sheets

TOILET FILL VALVE INCLUDING LEAK PREVENTION MECHANISM

CROSS-REFERENCE TO RELATED APPLICATION

This application claims priority to U.S. Provisional Patent Application No. 60/892,781 filed Mar. 2, 2007, which is incorporated herein by reference.

TECHNICAL FIELD OF THE DISCLOSURE

The present disclosure relates to fill valves for use in toilet tanks and, more particularly, to a mechanism for preventing leakage of water from a toilet tank between flush cycles.

BACKGROUND OF THE DISCLOSURE

Referring to FIG. 1, most toilet tanks include a float movable with the water level in the tank during flush cycles to operate a fill valve to refill the tank upon lowering of the water from a predetermined level and to close the fill valve once the tank is refilled to the predetermined level. During flush cycles, operation of a flush lever unseats a flush valve in the tank causing the water in the tank to be released through a discharge opening, and the float descends in response to lowering of the water level from the predetermined level, causing opening of the fill valve to refill the tank with closure of the flush valve. As the toilet tank is refilled, the float ascends in response to rising of the water level and, when the water level returns to the predetermined level, the float operates to close the fill valve and prevent further supply of water to the toilet tank.

A problem exists where the water level in the tank drops from the predetermined water level not due to flushing but due to leakage, typically through the flush valve, between flush cycles in that the float operates to open the fill valve allowing water to flow into the tank to replace that lost through leakage. During leakage, the float operates to keep the fill valve open such that water continually flows into the tank and through the discharge opening. On a small scale, this type of leakage is difficult to detect audibly and visually, such that the leakage problem can remain undetected and lead to wasted water. On a larger scale, the leakage can lead to flooding and property damage as well.

In many cases, consumers are alerted to major, continual leakage only through drastically high water utility bills while insidious or sporadic leakage can remain unrecognized with consumers inadvertently absorbing inflated water utility costs from the leakage. In addition to a direct economic burden on consumers, the aggregate effect of water leakage through deficient flush valves of toilet tanks is the waste of untold gallons of water, an increasingly scarce resource.

What is still desired is a new and improved mechanism for preventing leakage from a tank of a toilet. The mechanism will preferably prevent operation of a fill valve of the toilet unless and until a handle of the toilet is purposely operated to initiate a flush cycle.

SUMMARY OF THE DISCLOSURE

The present disclosure provides a toilet fill valve that includes a mechanism for preventing leakage from a tank of the toilet between flush cycles. The mechanism includes links that are normally locked to prevent the fill valve from opening. The links are operatively connected to a handle of the toilet such that the links are unlocked and allow the fill valve to open only when the handle of the toilet is purposely operated to initiate a flush cycle. Otherwise, the links do not allow the fill valve to open even if water leaks from the tank and causes a float of the fill valve to be lowered.

According to one aspect of the present disclosure, the leakage prevention mechanism can be manually disabled.

One embodiment of the present disclosure is directed to a fill valve assembly having a valve for controlling water flow into the toilet tank and a valve member coupled to the valve for movement between an open position that admits water through the valve and a closed position that closes the valve. A first locking link pivotally couples to the valve member and a second locking link pivotally couples to the first locking link. A valve reset lever pivotally connects to the second link and a float linkage pivotally connects to the valve reset lever. A buoyant float is secured to the float linkage, the buoyant float moving with a water level of the tank. A valve release lever has a first end coupled to move with the tank handle and a second end having a cam surface for urging the locking links from a locked to an unlocked position. In a full tank position, the locking links are locked to maintain the valve member in the closed position and the buoyant float may move down without opening the valve. In a flush initiated position, the cam surface of the release lever has unlocked the locking links and, in turn, the valve member moves to the open position.

Additional aspects and advantages of the present disclosure will become readily apparent to those skilled in this art from the following detailed description, wherein only an exemplary embodiment of the present disclosure is shown and described, simply by way of illustration of the best mode contemplated for carrying out the present disclosure. As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

BRIEF DESCRIPTION OF DRAWINGS

Reference is made to the attached drawings, wherein elements having the same reference character designations represent like elements throughout.

DETAILED DESCRIPTION OF EXEMPLARY EMBODIMENTS

Figure 1:
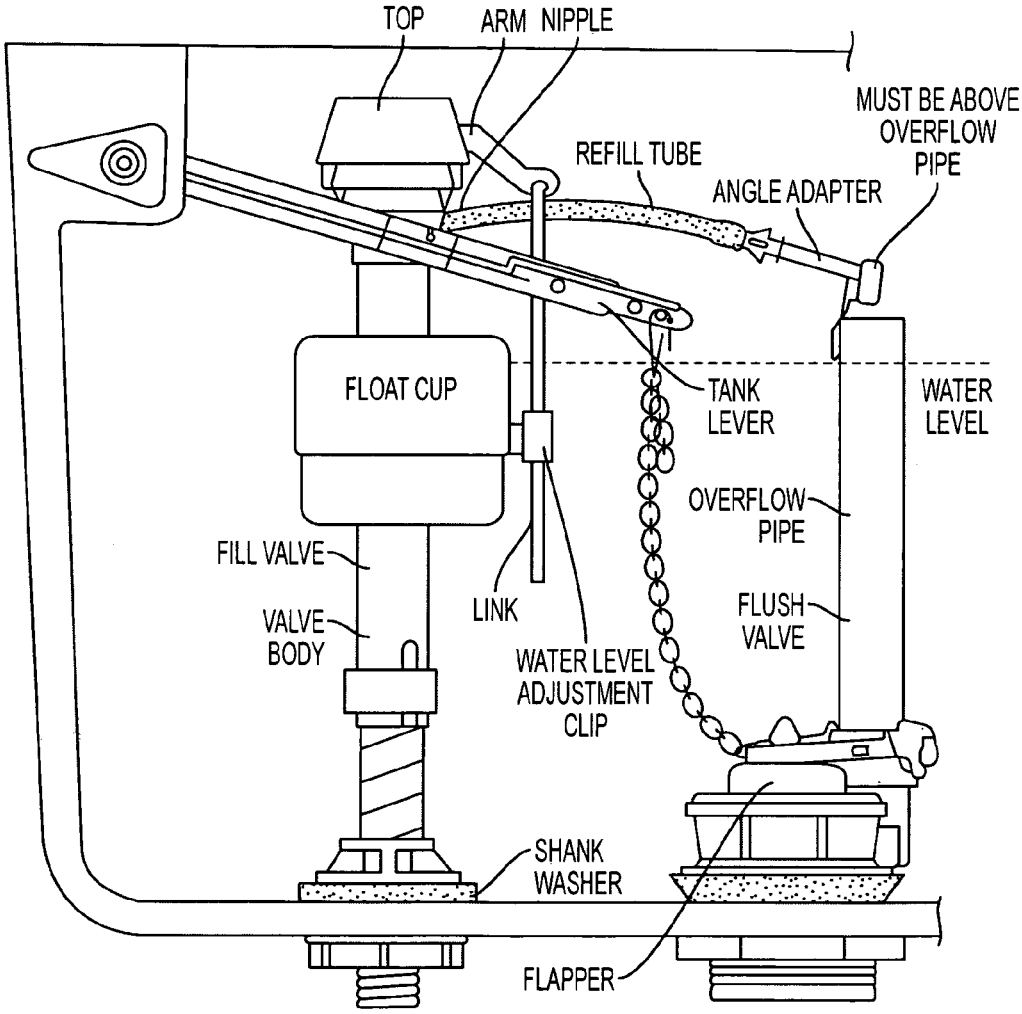
FIG. 1 PRIOR ART
FIG. 1 is a cut-away of a typical toilet flush tank constructed in accordance with the prior art.

FIG. 1 shows a typical toilet flush tank constructed in accordance with the prior art. The toilet includes exemplary embodiments of a handle, a flush valve, and a fill valve, all constructed in accordance the prior art. The flush valve includes an overflow pipe and a flapper. The handle is connected to a flush arm, which in turn is connected to the flapper with a chain. In FIG. 1, the flapper is shown in a closed position covering a drain of the tank. When the handle is turned to flush the toilet, the flush arm and the chain lift the flapper to an opened position. The opened flapper allows "old" water in the tank to drain into the toilet bowl. When the tank is drained or nearly drained the flapper falls back to a closed position to block the drain and allow the tank to be refilled.

Still referring to FIG. 1, the fill valve includes a valve member connected to a buoyant float by a float linkage. When the tank is drained the float drops with the tank water level and pulls open the valve member. The open valve member allows "new" water to flow into the tank from a water inlet. The water is directed from the fill valve through a refill tube to the overflow pipe of the flush valve. As the tank water level rises, the float also rises until the float closes the valve member of the fill valve and stops the water in-flow. The toilet is then ready for another flush cycle. The fill valve shown in FIG. 1 does not include means for preventing the valve member from being opened should water leak from the tank between flushes and cause the float to lower.

The present disclosure overcomes many of the prior art problems associated with fill valves. The advantages, and other features of the technology disclosed herein, will become more readily apparent to those having ordinary skill in the art from the following detailed description of certain preferred embodiments taken in conjunction with the drawings which set forth representative embodiments of the present invention and wherein like reference numerals identify similar structural elements. All relative descriptions herein such as top, bottom, left, right, up, and down are with reference to the Figures, and not meant in a limiting sense. Additionally, items not shown in the following figures are provided without reference numerals. In brief overview, the present disclosure provides a fill valve that includes a leak prevention mechanism, which prevents operation of the fill valve should water leak from the tank between flushes.

Figure 2:
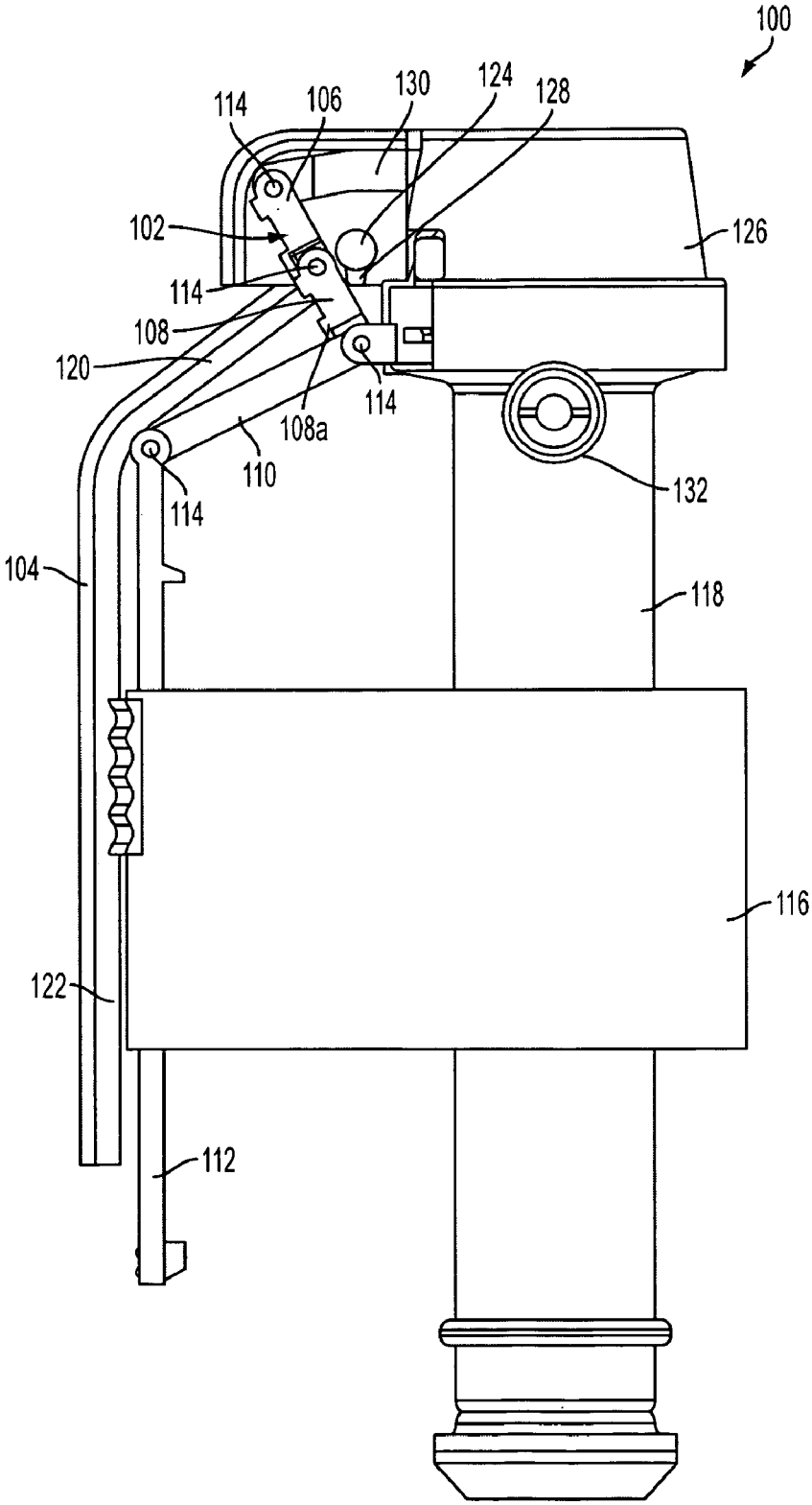
FIG. 2 is a side elevation view of an exemplary embodiment of a fill valve constructed in accordance with the present disclosure, wherein the fill valve is shown in a "full tank" position.

Referring to FIG. 2, a side elevation view of an exemplary embodiment of a fill valve assembly 100 constructed in accordance with the present disclosure is shown. The fill valve assembly 100 is shown positioned as if the toilet tank were full, e.g., a "full tank" position. The fill valve assembly 100 has a leak prevention mechanism 102 including a valve release lever 104 and locking links 106, 108.

The top link 106 is pivotally connected to a valve member 130 of the fill valve assembly 100 while the lower link 108 is pivotally connected a valve reset lever 110. The locking links 106, 108 are identical and pivotally connected together. Each link 106, 108 has a lower protrusion 106*a*, 108*a* and an upper shoulder 106*b*, 108*b*, respectively, best seen in FIG. 6. The links 106, 108 are arranged so that in a locked position, the lower protrusion 106*a* engages the upper shoulder 108*b* while the lower protrusion 108*a* is urged upward by the valve reset lever 110.

The valve reset lever 110 also is pivotally connected to a float linkage 112. Preferably, the links 106, 108, the lever 110 and the linkage 112 are coupled by pins 114. The float linkage 112 is secured to a buoyant float 116 that can move up or down on an elongated body 118 of the fill valve assembly 100.

The valve release lever 104 is elongated and includes an attachment end 120 and an opposite free end 122. The free end 122 of the lever 104 is roughly parallel the float linkage 112 in the full tank position. The attachment end 120 has a pivot pin 124 that extends through the cap 126 of the fill valve assembly 100 and pivotally connects the lever 104 to the cap 126. The pivot pin 124 includes a cam 128 for unlocking the links 106, 108 during flushing. The pivot pin 124 may also serve as a banking surface for the links 106, 108 when in the locked position. The links 106, 108 are coupled to a valve member 130, which allows water into the tank when open.

Figure 3:
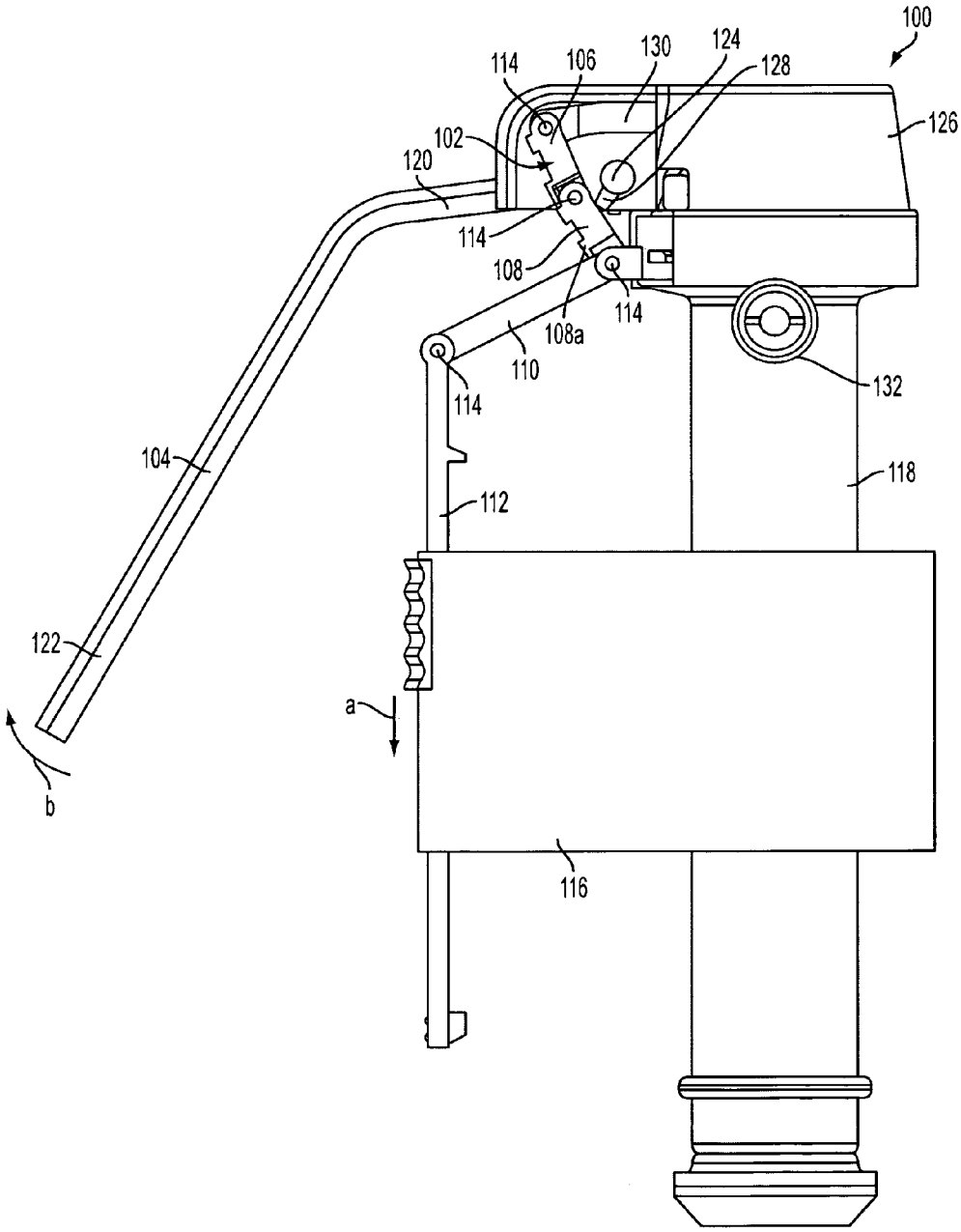
FIG. 3 is a side elevation view of the fill valve of FIG. 1, wherein the fill valve is shown in a "flush initiated" position.

Referring to FIG. 3, a side elevation view of the fill valve assembly 100 of FIG. 1 is shown with the fill valve assembly 100 just after the handle has been used to initiate flushing the toilet bowl, e.g., a "flush initiated" position. The handle temporarily raises the flapper of the flush valve to drain to the toilet tank. As the water drains from the toilet tank, the float 116 moves down along arrow "a". The float 116 pulls down the float linkage 112 and, thereby, the valve reset lever 110, but does not move or release the valve member 130 during the downward motion.

When the handle is turned to flush the toilet, the free end 122 of the lever 104 also moves along arrow "b" as shown in FIG. 3. For example, the free end 122 of the lever 104 is connected with a chain to the flush arm so that, the free end 122 is raised along with the flapper of the flush valve.

As the handle raises the free end 122 of the lever 1, the pivot pin 124 rotates so that the cam 128 strikes the locking links 106, 108. When the cam 128 strikes the locking links 106, 108, the links 106, 108 are pivoted outward and "unlocked" so that the valve member 130 opens. Thus, the valve member 130 is opened only when the toilet handle is turned to flush the toilet. So in the flush initiated position, the toilet tank is draining and, in turn, the float 116 is dropping but rather than the drop of the float 116 opening the valve member 130, upward movement of the lever 104 has opened the valve member to refill the toilet tank.

Figure 4:
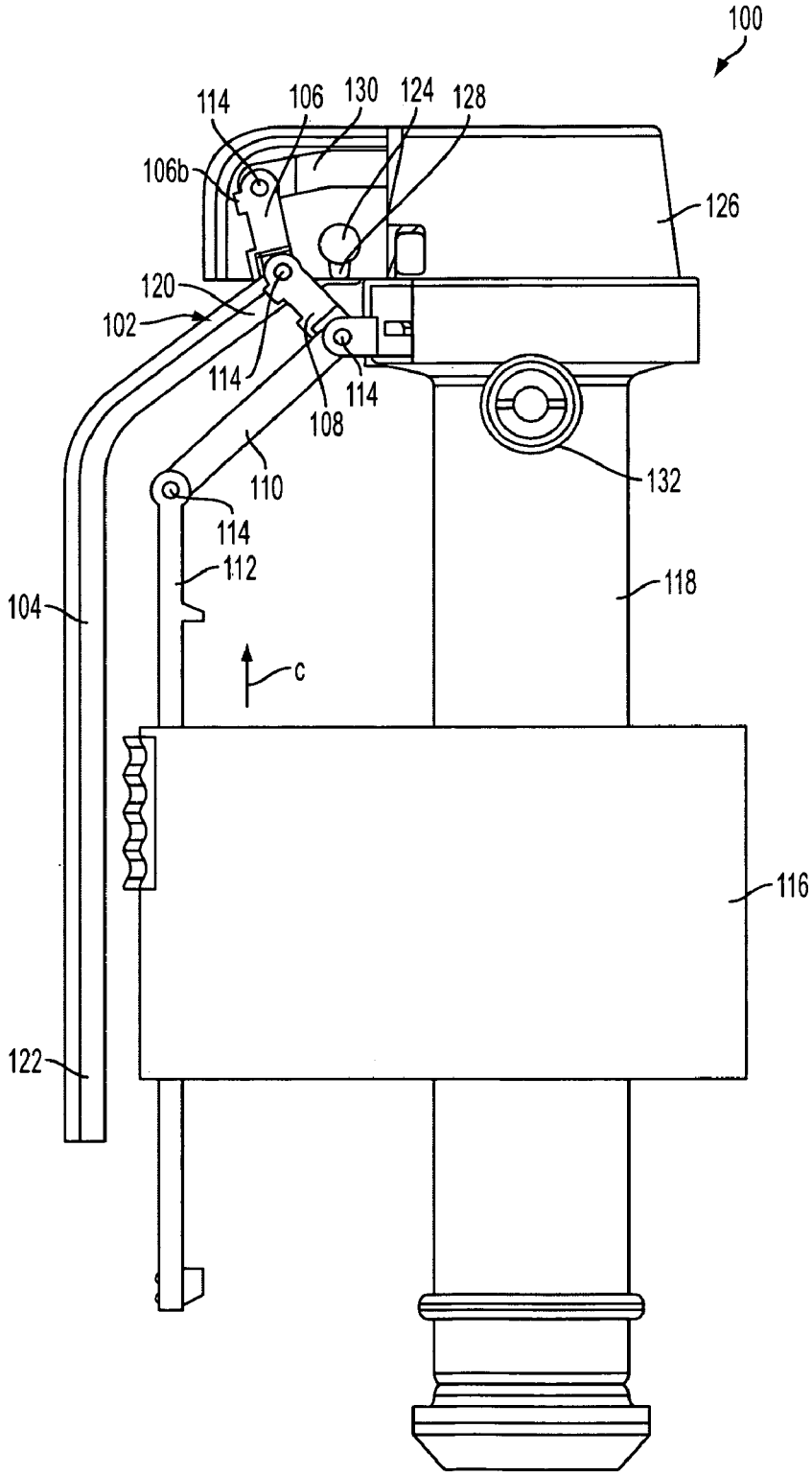
FIG. 4 is a side elevation view of the fill valve of FIG. 1, wherein the fill valve is shown in a "drained tank" position.

Referring now to FIG. 4, a side elevation view of the fill valve of FIG. 1 with the fill valve assembly 100 in a substantially empty or "drained tank" position is shown. After release of the handle, the lever 104 returns to being vertical but the valve member 130 remains open to put water into the tank. In other words, the links 106, 108 remain unlocked even though the lever 104 and cam 128 are no longer urging the links 106, 108 unlocked. Once the flapper closes, the tank begins to fill and, in turn, the float 116 rises along arrow "c".

As the float 116 moves up, the float 116 pushes the float linkage 112 and the valve reset lever 110 upward, such that the valve reset lever 110 pivots up. The valve reset lever 110 moving up applies a force to the locking links 106, 108 by virtue of upwardly engaging the lower protrusion 108*a*. As a result, the locking links 106, 108 pivot and align end-to-end into the locked position as shown in FIG. 2. When the locking links 106, 108 are aligned end-to-end in the locked position, the valve member 130 closes (i.e., the valve member 130 pivots upward) and becomes locked. When the valve member 130 closes, water stops entering the tank and the float is substantially returned to the position of FIG. 2. Thereafter, the valve member 130 will not pivot downward and open until the locking links 106, 108 are pivoted and unlocked by raising the lever 1.

Figure 5:
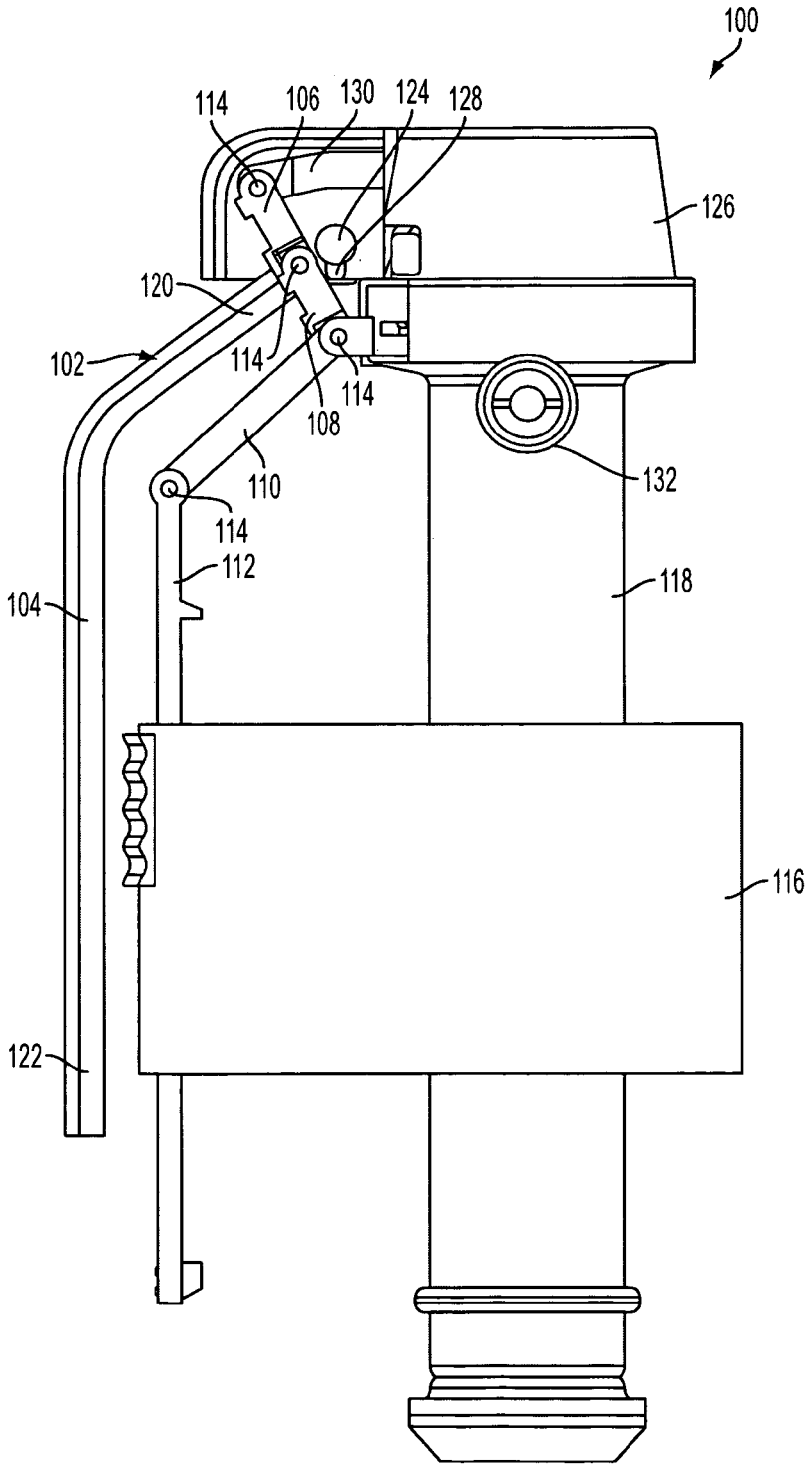
FIG. 5 is a side elevation view of the fill valve of FIG. 1, wherein the fill valve is shown during leakage from the toilet tank between flushes.

Referring now to FIG. 5, a side elevation view of the fill valve of FIG. 1 is shown to illustrate the fill valve assembly 100 during leakage from the toilet tank between flushes. The valve reset lever 110 and the locking links 106, 108 are adapted so that pivotal downward movement of the valve reset lever 110 does not cause pivotal movement of the locking links 106, 108. Thus, if when water leaks from the toilet tank and the float 116 moves downward along arrow "d", the valve reset lever 110 moved pivotally downward but the valve member 130 does not open. As a result, water is conserved.

The fill valve assembly 100 also includes a pressure relief valve assembly 132 constructed in accordance with U.S. Pat. No. 4,745,945 issued on May 24, 1988, which is incorporated herein by reference in its entirety. The pressure relief valve 132 is adapted to activate at a predetermined pressure to discharge water from a system of piping to relieve pressure due to thermal expansion of water in the piping system. As shown, the relief valve 132 is connected to the body 118 of the fill valve assembly 100.

Figure 6:
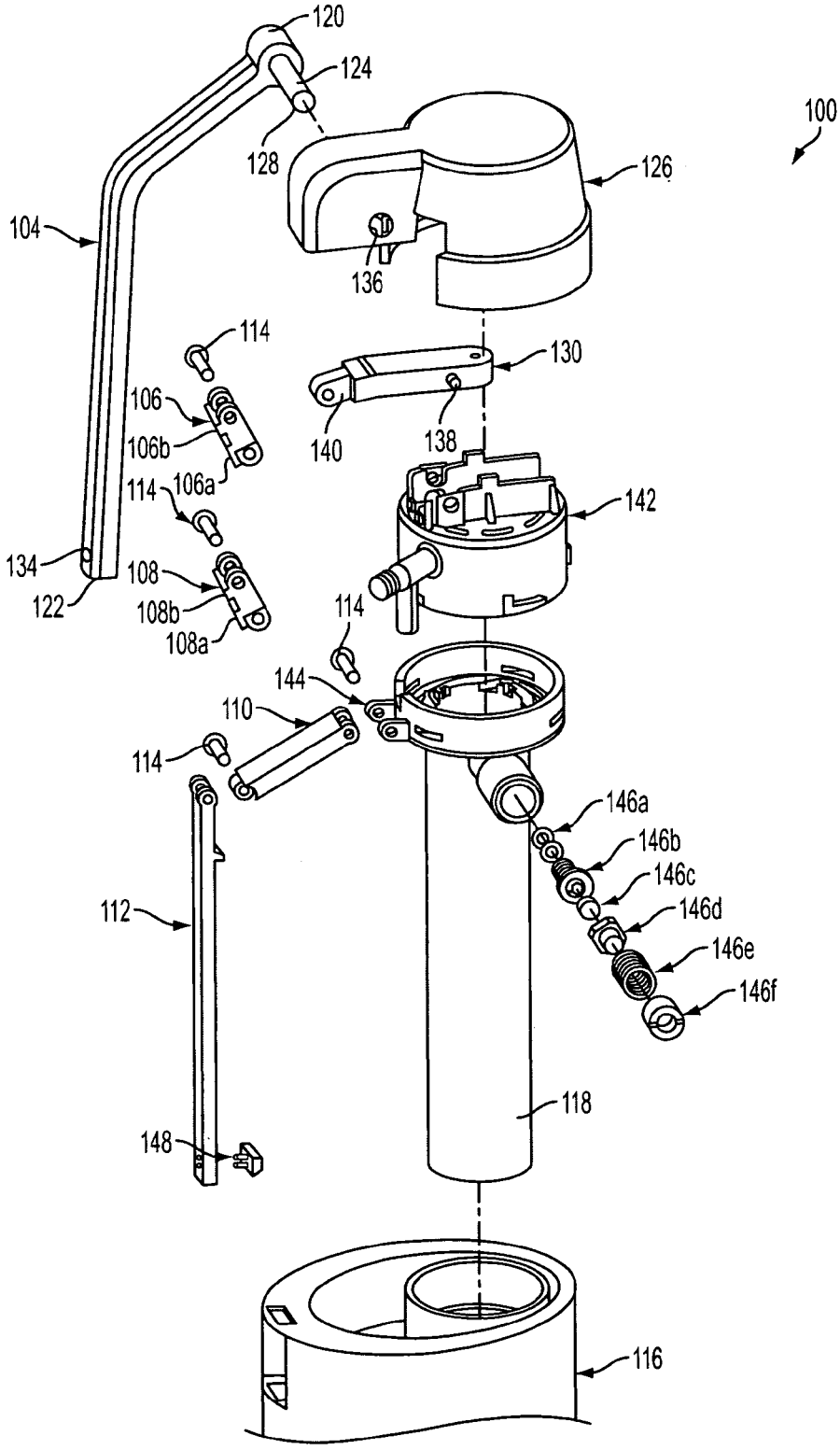
FIG. 6 shows an exploded, perspective view of the fill valve of FIG. 1.

Referring to FIG. 6, an exploded perspective view of the fill valve of FIG. 1 is shown. FIG. 6 well illustrates several components, features and the interconnections thereof. The following description is directed to some these additional details. Regarding the valve release lever 104, the free end 122 defines a hole 134 for attaching a connection to the toilet handle. The cap 126 defines opposing apertures 136 for receiving the pivot pin 124. The valve member 130 also includes pivot pins 138 and a shoulder 140 to couple intermediate the links 106, 108. The valve member 130 seats onto a valve head 142. The valve member 130 closes a small hole on top of the valve head 142 such that a diaphragm cannot deflate and blocks a water outlet at the top of the elongated body 118. The links 106, 108 do not need to fully align or lock for the valve member 130 to close the small hole.

The valve head 142 seats into a collar 144 of the elongated body 118. The collar 144 also provides an anchor point for the valve reset lever 110 and the thermally activated pressure relief valve 132. The components 146*a-f* of the relief valve 132 are shown and described in more detail in U.S. Pat. No. 4,745,945. A float stop 148 couples to the float linkage 112 to limit of the float 116 in the downward direction. Thus, the tank may simply empty if leaking and await refill until actuation of the handle to open the fill valve assembly 100.

Figure 7:
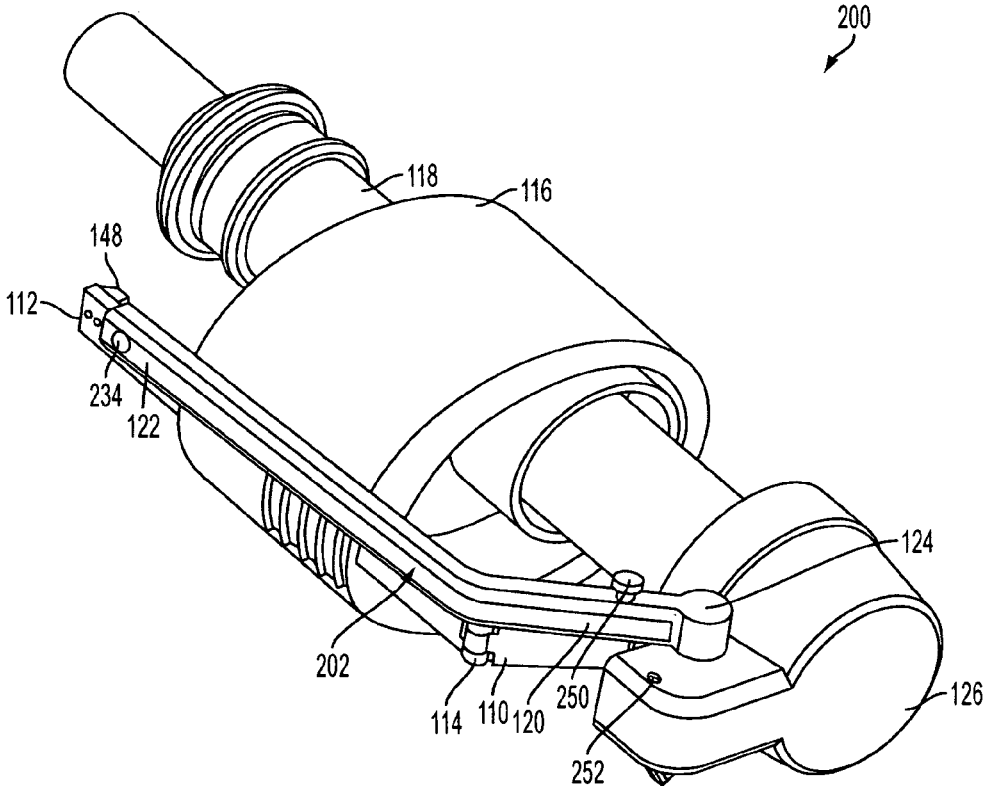
FIG. 7 is a top end perspective view of another exemplary embodiment of a fill valve constructed in accordance with the present disclosure, wherein a leak prevention mechanism of the fill valve is shown enabled.
Figure 8:
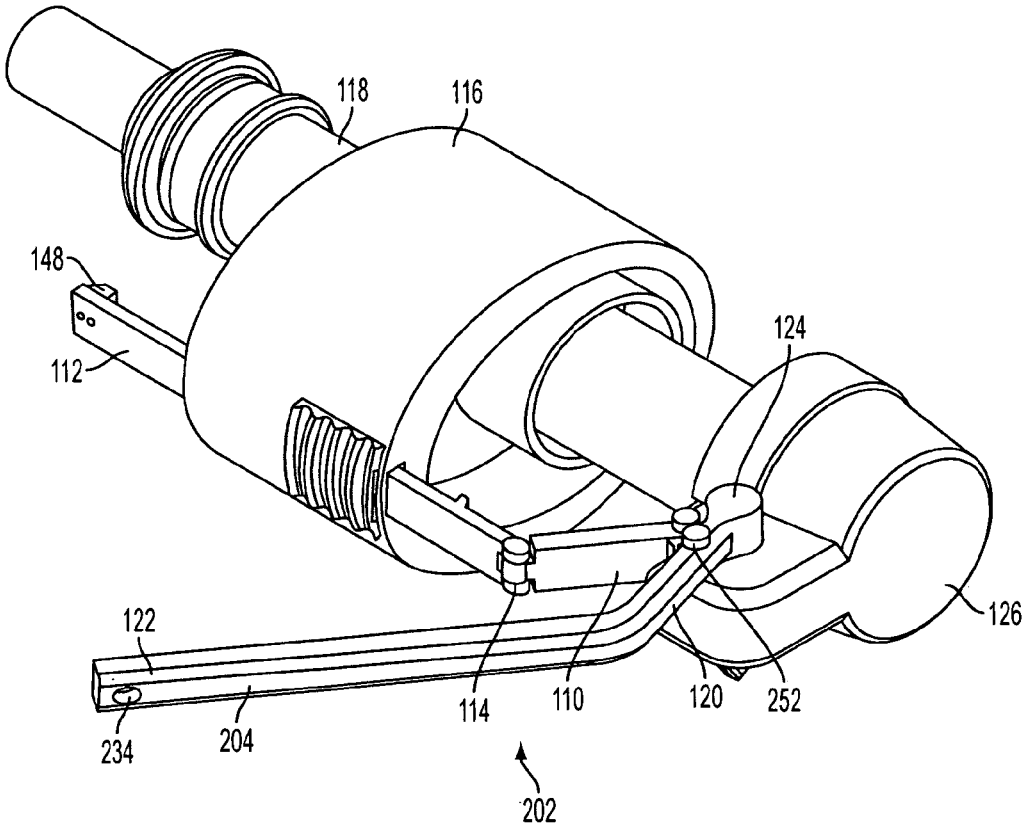
FIG. 8 is a top end perspective view of the fill valve of FIG. 10, wherein the leak prevention mechanism of the fill valve is shown disabled.

In FIGS. 7 and 8, another exemplary embodiment of a fill valve assembly 200 constructed in accordance with the present disclosure is shown. The fill valve of FIGS. 7 and 8 is similar to the fill valve assembly of FIGS. 1-6, but further includes a pin 250 for disabling the leak prevention mechanism 202. Accordingly, like reference numerals preceded by the numeral "2" instead of the numeral "1", are used to indicate like elements and the following description is directed to the differences only. In brief overview, when the leak prevention mechanism 202 is disabled, the valve member 130 becomes free to operate in a traditional manner, e.g., dropping and rising with the float 116.

The pin 250 is fitted on the valve release lever 204 and aligns with a hole 252 in the cap 226 when the lever 204 is raised. By pressing the pin 250 into the hole 252, as shown in FIG. 8, the pin 250 holds the lever 204 up and, in turn, keeps the camming surface 228 urging the links 206, 208 in an unlocked position. As a result, the leak prevention mechanism may be selectively disabled. In an alternative embodiment, the pin 250 may simply act as a set screw or catch to maintain the lever 204 in the up position.

In an alternative embodiment, in a flush initiated position, the cam surface of the release lever has unlocked the locking links so that as the buoyant float drops, the float linkage is pulled to pull the valve reset lever to pull the locking links and, in turn, the valve member moves to the open position. In another alternative embodiment, the lever is simply directly coupled to the pivot pin 114 between the links 106, 108 or such area to pull the links 106, 108 out of the locked position to open the valve. In an even simpler embodiment, the handle is simply directly linked to the links 106, 108 to urge the links 106, 108 into the unlocked position. As would be appreciated by those of ordinary skill in the art based upon review of the present disclosure, the linkages and actuation mechanism of the subject technology may be greatly varied and still be well within the scope of the subject invention.

Thus, the present disclosure provides a new and improved toilet fill valve assembly including a mechanism for preventing leakage. It should be understood, however, that the exemplary embodiments described in this specification have been presented by way of illustration rather than limitation, and various modifications, combinations and substitutions may be effected by those skilled in the art without departure either in spirit or scope from this disclosure in its broader aspects as defined by the appended claims.

What is claimed is:

1. A fill valve assembly, for a toilet, the toilet having a tank, a tank handle for opening and closing a drain to flush the toilet, the fill valve assembly comprising:

a valve head for providing water flow into the tank;

a valve member coupled to the valve head for movement between an open position that admits water through the valve head and a closed position that closes the valve head;

a first locking link pivotally coupled to the valve member;

a second locking link pivotally coupled to the first locking link;

a valve reset lever pivotally connected to the second link;

a float linkage pivotally connected to the valve reset lever;

a buoyant float secured to the float linkage, the buoyant float moving with a water level of the tank;

a valve release lever having a first end coupled to move with the tank handle and a second end having a cam surface for urging the locking links from a locked position to an unlocked position;

wherein, in a full tank position, the locking links are in the locked position to maintain the valve member in the closed position and the buoyant float may move down without opening the valve member, in a flush initiated position, the cam surface of the release lever has unlocked the locking links into the unlocked position and, in turn, the valve member moves to the open position, and each locking link has a lower protrusion and an upper shoulder, and the locking links are arranged so that in the locked position, the lower protrusion of the first locking link engages the upper shoulder of the second locking link without moving while the lower protrusion of the second locking link is urged upward by the valve reset lever and, thereby, the valve member is in the closed position, and in the unlocked position, the cam surface has urged the lower protrusion of the first locking link out of engagement with the upper shoulder of the second locking link and, thereby, the valve member is in the open position.

2. A fill valve assembly as recited in claim 1, wherein the locking links are identical in size and shape.

3. A fill valve assembly as recited in claim 1, further comprising a pressure relief valve connected to the valve head, wherein the pressure relief valve is adapted to activate at a predetermined pressure to discharge water to relieve pressure due to thermal expansion.

4. A fill valve assembly as recited in claim 1, wherein as the tank begins to fill after flushing, the buoyant float rises with the water level to push the float linkage and the valve reset lever upward, such that the valve reset lever applies a force to the locking links so that the locking links move into the locked position and close the valve member.

5. A fill valve assembly as recited in claim 1, further comprising a pin mounted on the valve release lever to selectively prevent the locking links from urging the valve member into the closed position.

6. A fill valve assembly for a toilet having a tank and a tank handle for flushing the toilet, the fill valve assembly comprising:

a valve head for providing water flow into the tank;

a valve member coupled to the valve head for movement between an open position that admits water through the valve head and a closed position that closes water flow through the valve head;

an upper locking link having a first end pivotally coupled to the valve member and a second end having a protrusion;

a lower locking link having a first end pivotally coupled to the second end of the upper locking link and a second end, the first end of the lower locking link having a shoulder;

a valve reset lever pivotally connected to the second end of the lower locking link;

a float linkage assembly pivotally connected to the valve reset lever;

a buoyant float secured to the float linkage, the buoyant float moving with a water level of the tank;

a valve release lever having a first end coupled to move with the tank handle and a second end having a cam surface for urging the locking links from a locked position to an unlocked position;

wherein, in a full tank position, the locking links in the locked position with the protrusion of the upper elongated locking link engaging the shoulder of the lower locking link in a fixed relationship to maintain the valve member in the closed position and the buoyant float may move down without opening the valve member, and in a flush initiated position, the cam surface of the release lever has moved the locking links to the unlocked position and, in turn, the valve member moves to the open position.

7. A fill valve assembly as recited in claim 6, wherein the lower elongated locking link has a protrusion on the second end that is urged upward by the valve reset lever in the closed position.

8. A fill valve assembly as recited in claim 6, wherein the locking links are identical in size and shape.

9. A fill valve assembly as recited in claim 6, further comprising an axial pin pivotally coupling the locking links together.

10. A fill valve assembly for a toilet having a tank and a tank handle for flushing the toilet, the fill valve assembly comprising:

a valve head for providing water flow into the tank;

a valve member coupled to the valve head for movement between an open position that admits water through the valve head and a closed position that closes water flow through the valve head;

an upper locking link having a first end pivotally coupled to the valve member and a second end;

a lower locking link having a first end pivotally coupled to the second end of the upper locking link and a second end;

a valve reset lever pivotally connected to the second end of the lower locking link;

a float linkage assembly pivotally connected to the valve reset lever;

a buoyant float secured to the float linkage, the buoyant float moving with a water level of the tank;

a valve release lever having a first end coupled to move with the tank handle and a second end having a banking surface fixedly setting the locking links with respect to each other in the locked position;

wherein, in a full tank position, the locking links are in the locked position to maintain the valve member in the closed position and the buoyant float may move down without opening the valve member, and in a flush initiated position, the release lever unlocks the locking links and, in turn, the valve member moves to the open position.

11. A fill valve assembly as recited in claim 10, wherein the second end of the valve release lever includes a pivot pin, which serves as the banking surface.

12. A fill valve assembly as recited in claim 10, further comprising a cam extending from the second end of the valve release lever, the cam having a cam surface that urges the locking links from the locked position to the unlocked position when the valve release lever moves to the flush initiated position.

13. A fill valve assembly as recited in claim 12, wherein when the cam surface urges the locking links, the locking links pivot out of an axial end-to-end alignment and unlock to allow pivotal movement so that the valve member moves to the open position.

14. A fill valve assembly as recited in claim 10, wherein:

the second end of the upper locking link has a protrusion;

the first end of the lower locking link has a shoulder; and when in the full tank position, the locking links are in the locked position with the protrusion of the upper locking link engaging the shoulder of the lower locking link.

15. A fill valve assembly for a toilet having a tank and a tank handle for flushing the toilet, the fill valve assembly comprising:

a valve head for providing water flow into the tank;

a valve member coupled to the valve head for movement between an open position that admits water through the valve head and a closed position that closes water flow through the valve head;

an upper elongated locking link having a first end pivotally coupled to the valve member and a second end;

a lower elongated locking link having a first end pivotally coupled to the second end of the upper elongated locking link and a second end;

a valve reset lever pivotally connected to the second end of the lower elongated locking link;

a float linkage assembly pivotally connected to the valve reset lever;

a buoyant float secured to the float linkage, the buoyant float moving with a water level of the tank;

a valve release lever having a first end coupled to move with the tank handle and a second end having a cam surface for urging the locking links from a locked position to an unlocked position;

wherein, in a full tank position, the locking links are fixed with respect to each other in an end-to-end orientation along an axis in the locked position and the float linkage may move without opening the valve member, and in a flush initiated position, the release lever unlocks the locking links and the locking links pivot out of end-to-end orientation and, in turn, the valve member moves to the open position.

16. A fill valve assembly as recited in claim 15, wherein the locking links are pivotally connected by an axial pin.

17. A fill valve assembly as recited in claim 15, wherein the second of the upper elongated locking link has a protrusion and the first end of the lower locking link has a shoulder such that the protrusion of the upper elongated locking link engages the shoulder of the lower elongated locking link in the locked position and the buoyant float may move without opening the valve.

* * * * *